US012172823B2

(12) United States Patent
Furudate et al.

(10) Patent No.: US 12,172,823 B2
(45) Date of Patent: Dec. 24, 2024

(54) LIQUID FILLING CONTAINER

(71) Applicant: HAKUGEN EARTH CO., LTD., Tokyo (JP)

(72) Inventors: Yuko Furudate, Tokyo (JP); Toyoko Aikawa, Sugito-machi (JP)

(73) Assignee: HAKUGEN EARTH CO., LTD, Tokyo (JP)

( * ) Notice: Subject to any disclaimer, the term of this patent is extended or adjusted under 35 U.S.C. 154(b) by 0 days.

(21) Appl. No.: 18/269,851

(22) PCT Filed: Mar. 10, 2022

(86) PCT No.: PCT/JP2022/010638

§ 371 (c)(1),
(2) Date: Jun. 27, 2023

(87) PCT Pub. No.: WO2022/196526

PCT Pub. Date: Sep. 22, 2022

(65) Prior Publication Data

US 2024/0059472 A1 Feb. 22, 2024

(30) Foreign Application Priority Data

Mar. 18, 2021 (JP) ..... JP2021-044867

(51) Int. Cl.
*B65D 81/26* (2006.01)
*B65D 1/28* (2006.01)
*B65D 81/18* (2006.01)

(52) U.S. Cl.
CPC ..... *B65D 81/266* (2013.01); *B65D 1/28* (2013.01); *B65D 81/18* (2013.01)

(58) Field of Classification Search
CPC ..... B65D 81/266; B65D 81/26; B65D 1/28; B65D 81/18; B65D 81/3205
(Continued)

(56) References Cited

U.S. PATENT DOCUMENTS 6,783,006 B1 * 8/2004 Sontag ..... A01N 25/34 206/524.1

FOREIGN PATENT DOCUMENTS

JP S59-30833 A 2/1984
JP S60-132828 U 9/1985
(Continued)

OTHER PUBLICATIONS

May 24, 2022 International Search Report issued in International Patent Application No. PCT/JP2022/010638.
(Continued)

*Primary Examiner* — Rafael A Ortiz
(74) *Attorney, Agent, or Firm* — Oliff PLC

(57) ABSTRACT

A liquid filling container includes: a resin container main body having an opening in an upper portion; a moisture-permeable waterproof sheet covering the opening; and a liquefying agent or a liquid filled in the resin container main body, and is configured such that a maximum thickness of the resin container main body is 400 μm or less, and when a direction along a longitudinal direction of the opening of the moisture-permeable waterproof sheet is defined as a sheet longitudinal direction LD, and a direction along a lateral direction of the opening of the moisture-permeable waterproof sheet is defined as a sheet lateral direction SD, a tensile breaking strength in the sheet longitudinal direction LD and the sheet lateral direction SD is 40 (N/25 mm) or more, and a tensile elongation at break in the sheet lateral direction SD is 60% or more.

7 Claims, 7 Drawing Sheets

(58) Field of Classification Search
USPC ..... 206/524.1, 524.3
See application file for complete search history.

(56) References Cited

FOREIGN PATENT DOCUMENTS

| | | | | |
|---|---|---|---|---|
| JP | H06-344484 | A | | 12/1994 |
| JP | H09-174737 | A | | 7/1997 |
| JP | 10180030 | | * | 7/1998 |
| JP | H10-180030 | A | | 7/1998 |
| JP | 2001149734 | | * | 6/2001 |
| JP | 2001-354274 | A | | 12/2001 |
| JP | 2001354274 | | * | 12/2001 |
| JP | 2005-007756 | A | | 1/2005 |
| JP | 2012-143675 | A | | 8/2012 |
| JP | 2022-057079 | A | | 4/2022 |

OTHER PUBLICATIONS

May 24, 2022 Written Opinion issued in International Patent Application No. PCT/JP2022/010638.

* cited by examiner

LIQUID FILLING CONTAINER

TECHNICAL FIELD

The present invention relates to a liquid filling container filled with a liquefying agent or a liquid.

BACKGROUND ART

Conventionally, there has been known a liquid filling container including a resin container main body having an opening in an upper portion and a moisture-permeable waterproof sheet covering the opening, the resin container main body being filled with a liquid agent, a deliquescent agent, or the like. Examples of the liquid agent or the deliquescent agent to be filled include an aromatic agent, a deodorant, an antifungal agent, and a dehumidifying agent. The moisture-permeable waterproof sheet is a sheet having air permeability and moisture permeability and capable of suppressing permeation of liquid. Such a liquid filling container is placed in an arbitrary space such as a room or a storage space such as a closet. Such a resin container main body has a function of releasing an aromatic component, a deodorant component, an antifungal component, or the like to an external space through the moisture-permeable waterproof sheet, or absorbing moisture in the external space into the resin container main body.

Examples of the liquid filling container described above include a type in which the resin container main body is already filled with the liquid agent at the start of use. As another type, there is also a type in which the resin container main body is filled with a solid agent such as a deliquescent agent at the start of use, and the liquid is stored in the resin container main body by exerting an action such as moisture absorption. In any of these types, the liquid filling container needs to have a structure in which the liquid in the resin container main body is reliably held and does not leak, even when the liquid filling container receives an impact such as dropping. Therefore, the liquid filling container is required to have good sealability and impact resistance.

Therefore, the resin container main body in the conventional liquid filling container is generally a box-shaped resin molded product having an upper opening produced by injection molding of a synthetic resin, which ensures liquid retention and impact resistance. In addition, sealability against liquid is ensured by covering the opening of the box-shaped resin molded product with the moisture-permeable waterproof sheet that has air permeability and moisture permeability and suppresses permeation of liquid.

On the other hand, as a part of measures against environmental problems in recent years, resource saving and waste reduction are required, and a reduction in an amount of waste is also required for synthetic resin molded articles. Therefore, it is required to reduce an amount of resin used when producing a resin molded article.

On the other hand, for example, Patent Literature 1 below discloses an attempt to form a resin container main body with a thermoplastic resin sheet. Specifically, Patent Literature 1 discloses a type of dehumidifying agent container including a resin container main body formed of a thermoplastic resin sheet, and an inner tray supported on an inner surface of the resin container main body, vertically partitioning an inside of the resin container main body, and having a plurality of holes. Such a dehumidifying agent container has a configuration in which a granular dehumidifying agent (deliquescent agent) is placed on the inner tray, and a deliquescent liquid generated from the dehumidifying agent by use is allowed to pass downward from a hole formed in the inner tray to be stored.

CITATION LIST

Patent Literature

Patent Literature 1: JP 2012-143675 A

SUMMARY OF INVENTION

Technical Problem

However, the dehumidifying agent container described in Patent Literature 1 is required to have rigidity enough to support the inner tray on which the dehumidifying agent is placed by the inner surface of the resin container main body. Therefore, the resin container main body has to be made thick, which is not sufficient in reducing the amount of the resin to be used.

Therefore, the present inventors have studied a liquid filling container including a thinner resin container main body without the inner tray. However, it has been found that there is a problem that liquid retention is reduced due to thinning of the resin container main body.

That is, a conventional product including the resin container main body that is an injection-molded product using the synthetic resin is sufficiently thick and excellent in impact resistance, and therefore even when receiving the impact such as dropping in a state where a large amount of liquid is contained therein, the impact can be well absorbed. Therefore, the thick conventional resin container main body hardly causes a problem that the liquid leaks out of the container due to dropping or the like, and has excellent liquid retention.

On the other hand, when a thin resin container main body formed by reducing the amount of the resin as much as possible receives the impact such as dropping in a state where the liquid is contained, the impact cannot be fully absorbed, and as a result, the impact tends to propagate strongly to the liquid therein. The liquid to which the impact is propagated flows instantaneously inside the resin container main body and presses the moisture-permeable waterproof sheet covering the opening of the resin container main body from the inside. Thus, the moisture-permeable waterproof sheet may be broken, and the liquid may leak out of the container.

The present invention has been made in view of the above-described problems. That is, an object of the present invention is to provide a liquid filling container in which the amount of the resin forming the resin container main body is sufficiently reduced, and leakage of the liquid as a content is suppressed even when the impact such as dropping is received.

Solution to Problem

A liquid filling container of the present invention includes: a resin container main body having an opening in an upper portion; a moisture-permeable waterproof sheet covering the opening; and a liquefying agent or a liquid filled in the resin container main body, in which a maximum thickness of the resin container main body is 400 μm or less, and when a direction along a longitudinal direction of the opening of the moisture-permeable waterproof sheet is defined as a sheet longitudinal direction, and a direction along a lateral direction of the opening of the moisture-permeable waterproof sheet is defined as a sheet lateral direction, a tensile breaking strength in the sheet longitudinal direction and the sheet lateral direction is 40 (N/25 mm) or more, and a tensile elongation at break in the sheet lateral direction is 60% or more.

Advantageous Effects of Invention

In the liquid filling container of the present invention having the above configuration, the maximum thickness of the resin container main body is as thin as 400 μm or less, the amount of the resin used is sufficiently reduced, and the moisture-permeable waterproof sheet is less likely to be broken even when the liquid filling container receives the impact such as dropping, and the liquid is less likely to leak out of the container. Therefore, the liquid filling container of the present invention is suitable as a container that stores a liquid agent such as the aromatic agent, the deodorant, or the antifungal agent, or stores a type of agent that liquefies after the start of use, such as a deliquescent dehumidifying agent.

DESCRIPTION OF EMBODIMENTS

Figure 3:
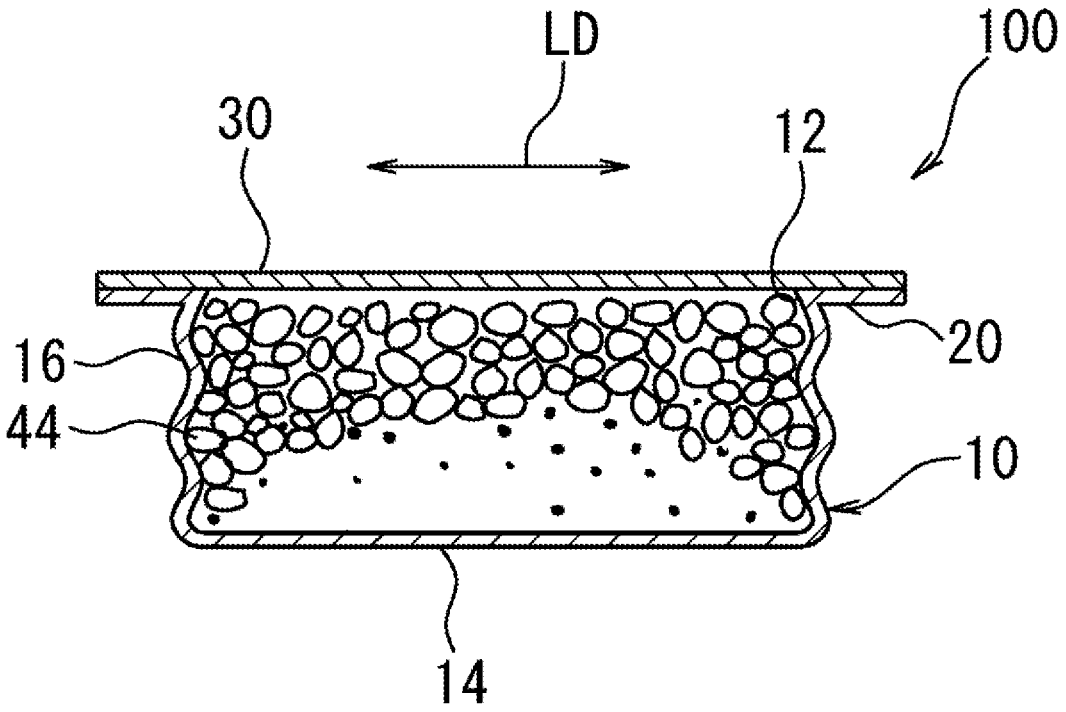
FIG. 3 is a cross-sectional view of the liquid filling container according to another embodiment of the present invention.
Figure 4:
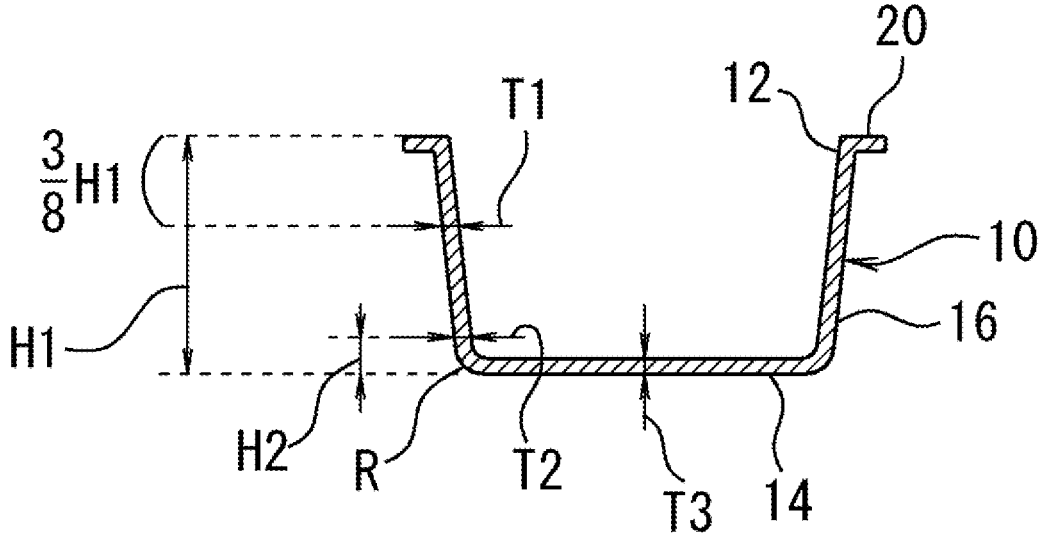
FIG. 4 is a cross-sectional view of a resin container main body in one embodiment of the present invention.
Figure 5A:
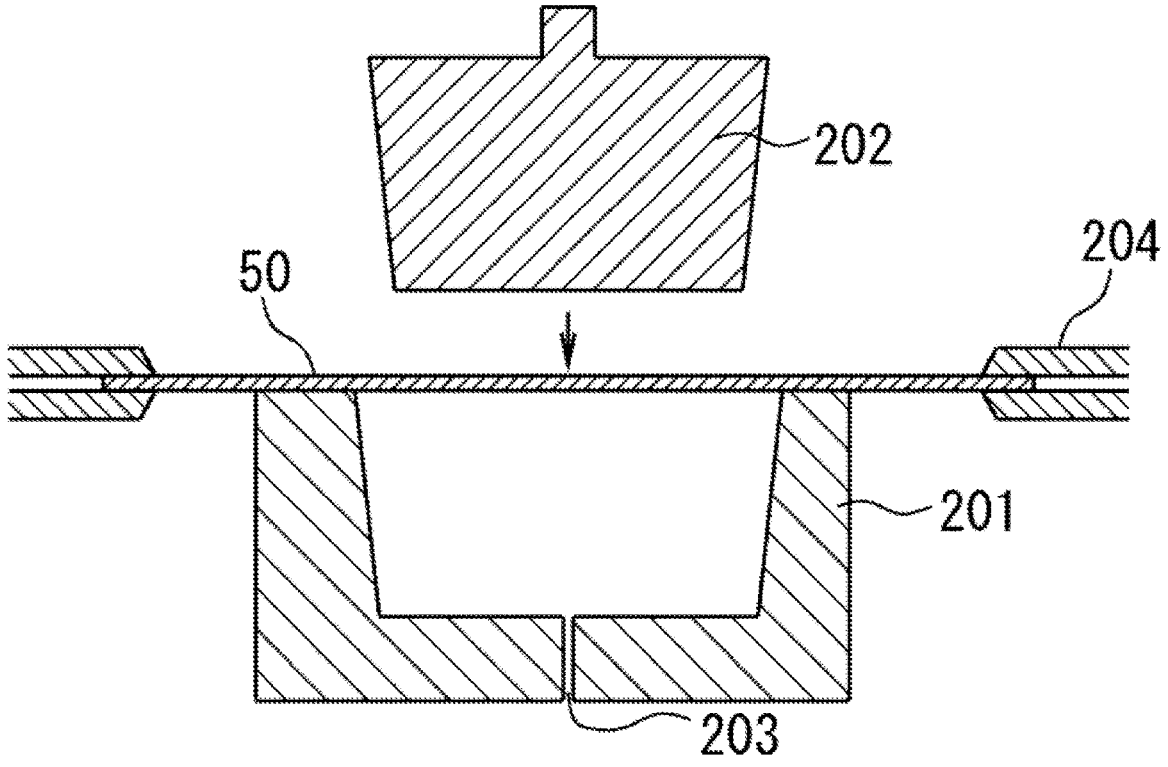
FIGS. 5A to 5C are cross-sectional views illustrating steps of a method for producing the resin container main body in the present invention.
Figure 5B:
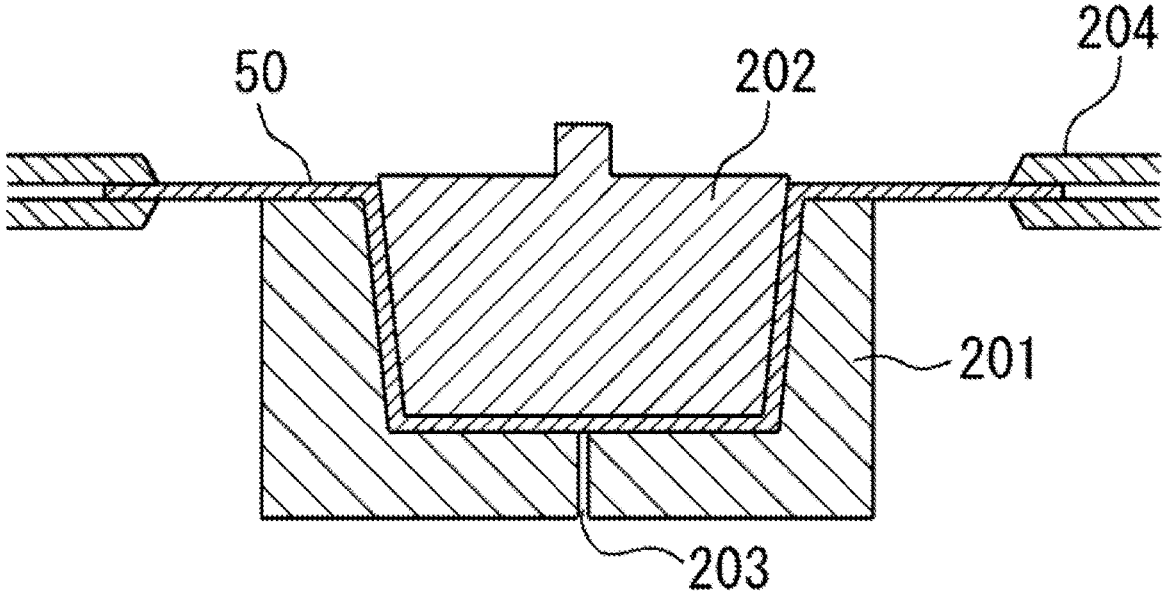
Figure 5C:
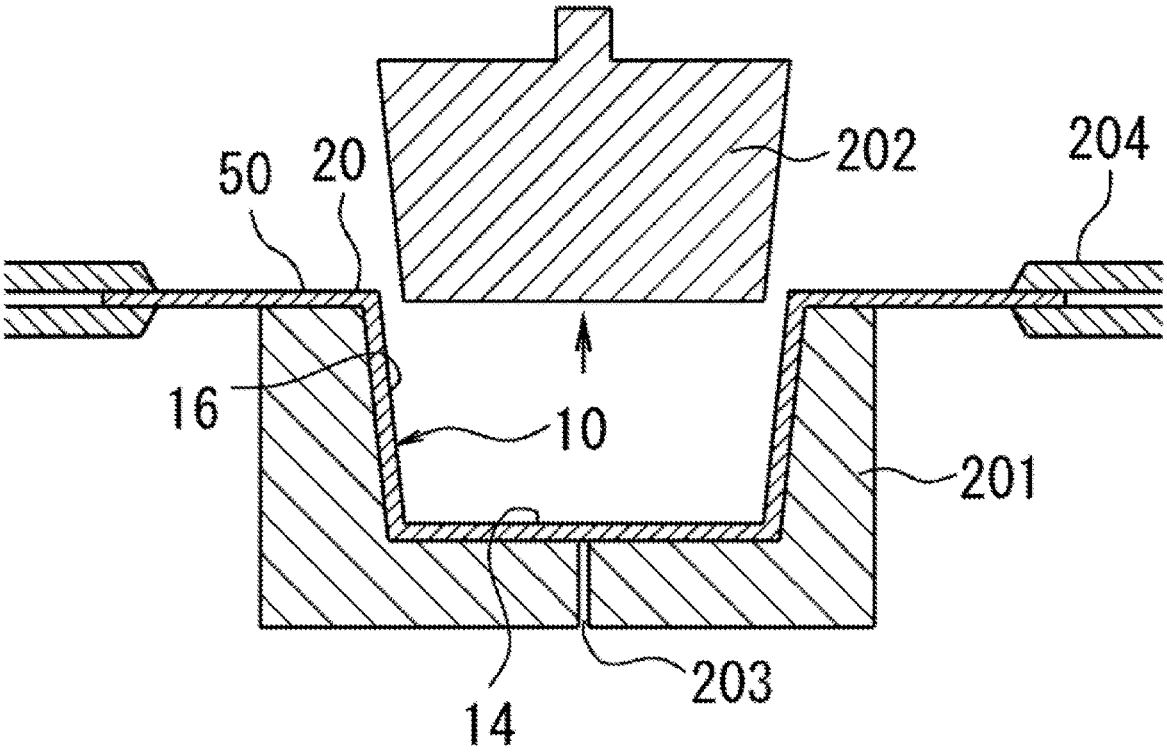

Hereinafter, an embodiment of the present invention will be described with reference to FIGS. 1 to 5 (FIG. 5A to FIG. 5C). In all the drawings, the same components are denoted by the same reference numerals, and redundant description will be omitted as appropriate. Note that the drawings used in the description of the present invention do not limit the present invention and dimensions, dimensional ratios, and shapes of members included in the present invention.

Figure 1:
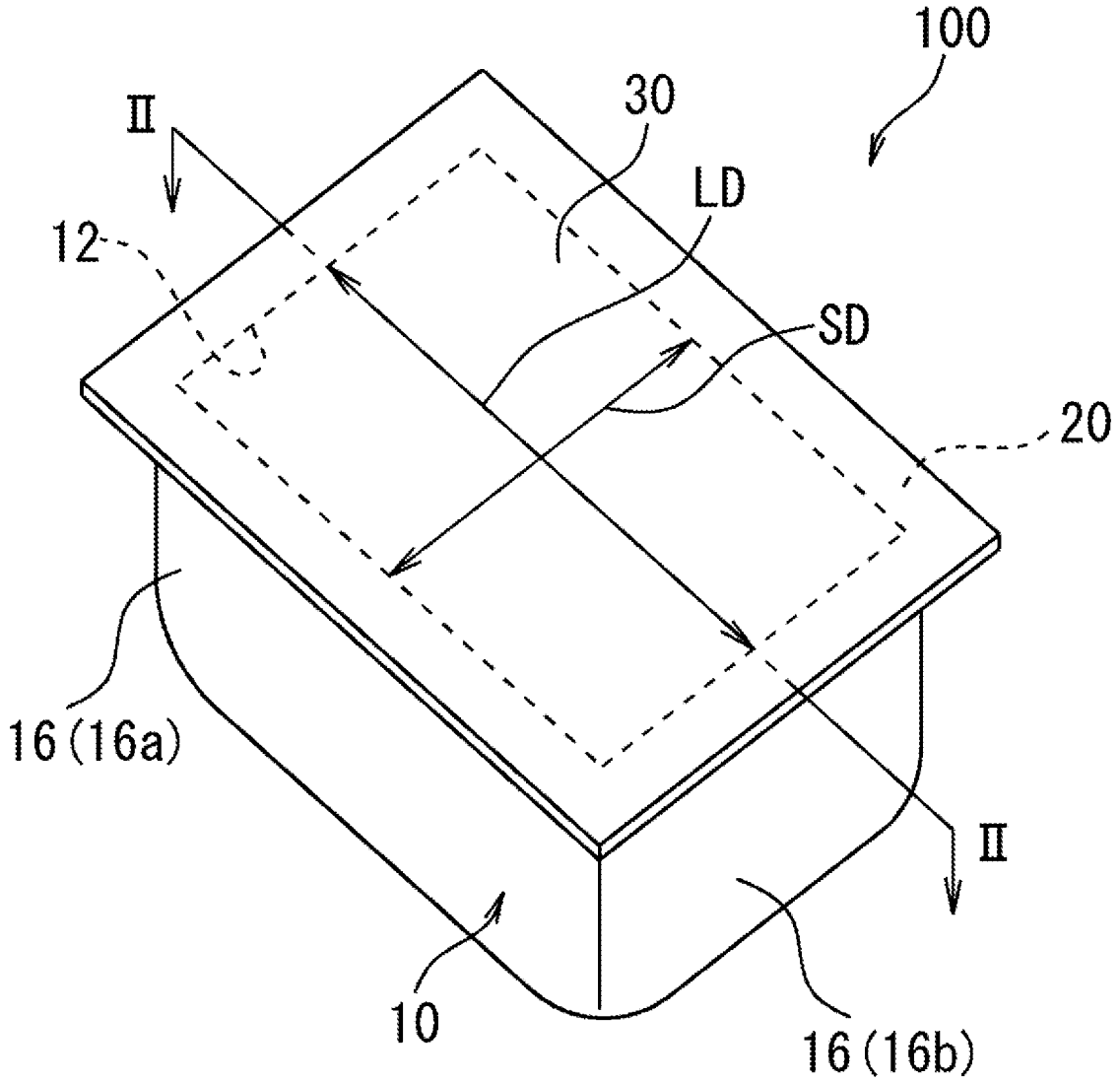
FIG. 1 is a perspective view of a liquid filling container according to one embodiment of the present invention.
Figure 2:
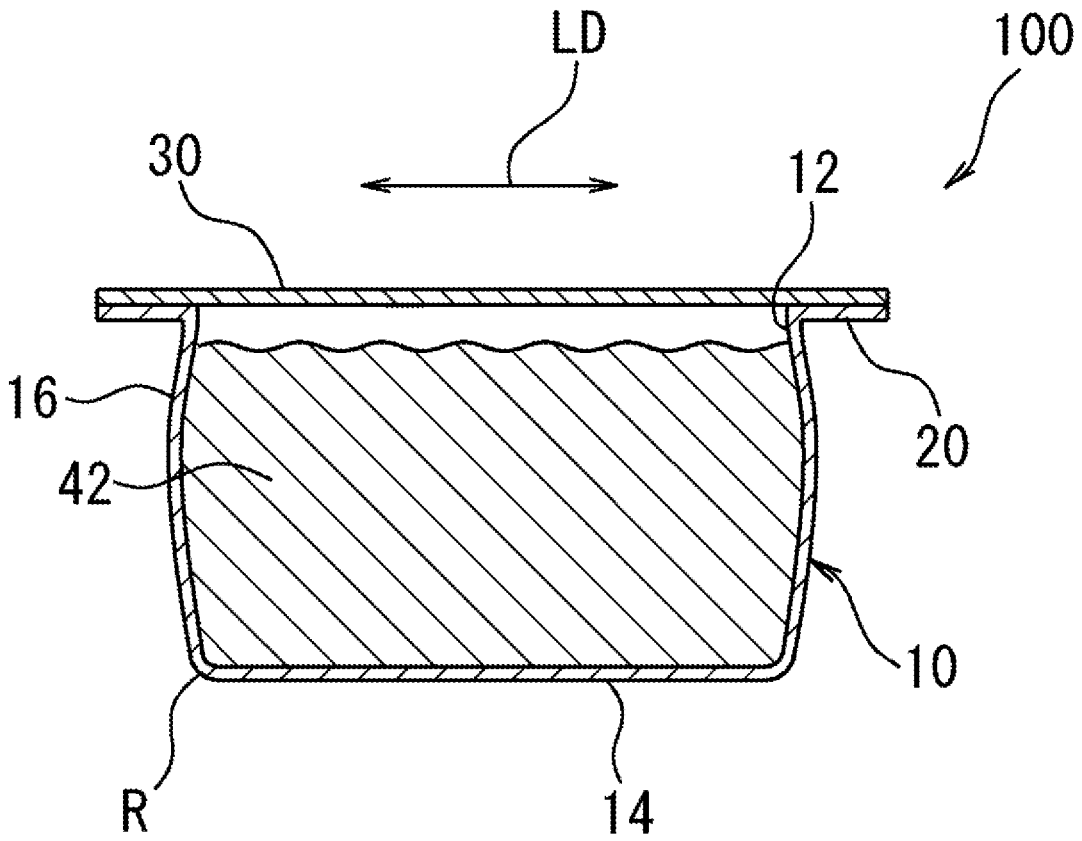
FIG. 2 is a cross-sectional view taken along line II-II of the liquid filling container illustrated in FIG. 1.

FIG. 1 is a perspective view of a liquid filling container 100 according to one embodiment of the present invention. FIG. 2 is a cross-sectional view taken along line II-II of the liquid filling container 100 illustrated in FIG. 1. FIG. 3 is a cross-sectional view of the liquid filling container 100 according to another embodiment of the present invention. FIG. 4 is a cross-sectional view of a resin container main body 10 in one embodiment of the present invention. FIGS. 5A to 5C are cross-sectional views illustrating steps of a method for producing the resin container main body 10 in the present invention.

In the following description of the liquid filling container, the vertical direction refers to a vertical direction when the liquid filling container is horizontally placed in a normally used posture unless otherwise specified. Further, in the present invention, the liquid filling container includes both a container in which an inside of the resin container main body is already filled with liquid at the start of use and a container in which the resin container main body is filled with a solid liquefying agent at the start of use, and the liquid is stored in the resin container main body due to moisture absorption or the like as time passes. In addition, in the present invention, the liquid that can be contained in the resin container main body includes not only a liquid material but also a semi-liquid material such as sol or gel. This is because, when a moisture-permeable waterproof sheet is damaged due to dropping or the like, damage to surroundings when these semi-liquid materials flow out from the inside of the container main body is large as in a case of the liquid.

As illustrated in FIG. 1, the liquid filling container 100 includes a resin container main body 10 having an opening 12 in an upper portion, a moisture-permeable waterproof sheet 30 covering the opening 12, and a liquefying agent (see reference numeral 44 in FIG. 3) or a liquid (see reference numeral 42 in FIG. 2) filled in the resin container main body 10. In the present invention, a maximum thickness of the resin container main body 10 is 400 μm or less, and when a direction along a longitudinal direction of the opening 12 of the moisture-permeable waterproof sheet 30 is defined as a sheet longitudinal direction LD, and a direction along a lateral direction of the opening 12 of the moisture-permeable waterproof sheet 30 is defined as a sheet lateral direction SD, a tensile breaking strength (N/25 mm) in the sheet longitudinal direction LD and the sheet lateral direction SD is 40 (N/25 mm) or more, and a tensile elongation at break (%) in the sheet lateral direction SD is 60% or more.

As a result of repeated studies in view of the above-described problems, the present inventors have obtained the following findings. That is, the moisture-permeable waterproof sheet covering the opening of the liquid filling container is generally thin and microporous in order to ensure air permeability and moisture permeability, and has a lower tensile breaking strength than the resin container main body. Therefore, it has been found that when the liquid filling container including a thin resin container main body receives an impact due to dropping or the like and the impact is propagated to the liquid filled therein, the moisture-permeable waterproof sheet is broken by pressing of the liquid.

Therefore, in order to prevent the moisture-permeable waterproof sheet from being damaged when receiving the impact, it was attempted to use the moisture-permeable waterproof sheet having a high tensile breaking strength. However, it has been found that even when the moisture-permeable waterproof sheet having improved tensile breaking strength is used, the above-described problems are not sufficiently solved. As a result of further studies based on such findings, it has been found that the above-described problems can be satisfactorily solved by using the moisture-permeable waterproof sheet having improved tensile breaking strength and exhibiting tensile elongation at break under specific conditions, and the present invention having the above configuration has been completed.

That is, although the liquid filling container 100 of the present invention having the above-described configuration is a container in which the resin container main body 10 is thin and an amount of synthetic resin used is small, the moisture-permeable waterproof sheet 30 is less likely to break due to the impact such as dropping. Therefore, the liquid filling container 100 is suitable as a container for a liquid agent such as an aromatic agent, a deodorant, and an antifungal agent, a deliquescent dehumidifying agent that liquefies with moisture absorption, or the like.

In particular, in recent years, with an increase in capacity of storage spaces such as walk-in closets, there is an increasing need for large-capacity type such as the aromatic agent, the deodorant, the dehumidifying agent, and the antifungal agent placed in the storage spaces. The liquid filling container such a large-capacity type has a large amount of liquid held in the container main body, and thus a risk of damage of the moisture-permeable waterproof sheet increases when receiving the impact such as dropping. On the other hand, in a case of the liquid filling container 100 of the present invention, since the amount of resin used to form the resin container main body 10 is small, the environment can be taken into consideration, and the moisture-permeable waterproof sheet 30 is less likely to be damaged and excellent in liquid retention even when receiving the impact such as dropping.

Hereinafter, the liquid filling container 100 will be described in more detail.

(Resin Container Main Body)

As illustrated in FIGS. 1 and 2, the liquid filling container 100 includes the resin container main body 10 and the moisture-permeable waterproof sheet 30.

The resin container main body 10 is a container having the opening 12 in an upper portion and capable of storing the liquid 42. The resin container main body 10 in the present embodiment has a bottom surface portion 14 and a side surface portion 16 extending upward from an outer edge of the bottom surface portion 14, and is provided with the opening 12 on an upper end side of the side surface portion 16. In the present embodiment, the bottom surface portion 14 has a substantially rectangular shape, and the resin container main body 10 is a rectangular parallelepiped with an upper surface opening. A shape of the bottom surface portion 14 and a shape of the opening 12 are preferably the same or similar, and in the present embodiment, they are substantially the same in a top view. Therefore, the longitudinal direction and the lateral direction of the opening 12 are respectively parallel or substantially parallel to the longitudinal direction and the lateral direction of the bottom surface portion 14. The liquid filling container 100 of the present embodiment including the rectangular bottom surface portion 14 and having a substantially rectangular parallelepiped shape as a whole can be said to have a suitable shape that can be easily placed in a gap or the like. Note that the term "substantially rectangular parallelepiped" as used herein includes, for example, an aspect in which the side surface portion 16 is slightly curved outward by a weight of the liquid 42 as illustrated in FIG. 2.

The resin container main body 10 in the present embodiment is provided with a flange portion 20 extending from an upper end of the side surface portion 16. The flange portion 20 extends from the upper end of the side surface portion 16 in a direction intersecting the vertical direction, and an upper surface side of the flange portion 20 is a bonding surface with the moisture-permeable waterproof sheet 30. Although the flange portion 20 is an optional component, it is preferable to include the flange portion 20 since the moisture-permeable waterproof sheet 30 can be firmly fixed to and supported by the resin container main body 10. For example, as illustrated in FIG. 2, the flange portion 20 extends substantially horizontally outwardly of the container from the upper end of the side surface portion 16. In addition, as a modification not illustrated, the flange portion 20 may extend inwardly of the container (that is, in a direction that does not protrude outwardly from the resin container main body 10 in a top view). The flange portion 20 is provided in at least a part of the opening 12, and is preferably provided on the entire circumference of the opening.

In the present invention, the maximum thickness of the resin container main body 10 is 400 μm or less. Thus, the amount of resin used is remarkably reduced as compared with the conventional case. For example, in view of the fact that in a general liquid filling container (commercially available product) including a resin container main body which is a conventional injection molded article, cases where a thickness of a side wall of the resin container main body is 600 μm to 1100 μm are seen here and there, it is understood that the amount of resin used in the resin container main body 10 of the present invention is sufficiently reduced.

In the present invention, the maximum thickness of the resin container main body 10 means a portion having the largest thickness measured in the bottom surface portion 14 and the side surface portion 16 of the resin container main body 10. In addition, by producing the resin container main body 10 by plug assist molding described later using a resin sheet having a thickness of 400 μm, the maximum thickness of the resin container main body 10 can be reliably set to 400 μm or less.

A configuration of the resin container main body 10 will be described in more detail with reference to FIG. 4.

In the resin container main body 10, an average thickness T3 of the bottom surface portion 14 only needs to be 400 μm or less. The average thickness T3 of the bottom surface portion 14 is not particularly limited, but for example, the average thickness is preferably 160 μm or more and 350 μm or less from the viewpoint of maintaining favorable shape retainability of the liquid filling container 100. In the present invention, the average thickness T3 of the bottom surface portion 14 refers to a thickness of a central portion of the bottom surface portion 14 of the resin container main body 10.

Further, in the resin container main body 10, an average thickness of the side surface portion 16 only needs to be 400 μm or less. The average thickness of the side surface portion 16 is not particularly limited, but an average thickness T1 of the side surface portion 16 at a predetermined height is preferably 60 μm or more and 110 μm or less from the viewpoint of maintaining appropriate strength in a state of being filled with the liquid. Here, the average thickness T1 at the predetermined height refers to an average thickness of the side surface portion 16 at a height position of ⅜ from the opening 12 with respect to a height H1 from an installation surface to the opening 12. The average thickness T1 of the side surface portion 16 can be obtained by measuring thicknesses at four randomly selected positions at the above-described predetermined height and arithmetically averaging the measured values.

Further, in the side surface portion 16, an average thickness T2 at a position near a corner R of the quadrilateral bottom surface portion 14 is not particularly limited, but is preferably 30 μm or more and 110 μm or less. In particular, when the resin container main body 10 is produced by plug assist molding described later, an average thickness T2 measurement region near the corner R is a portion where the resin sheet is most stretched and thinned. In the liquid filling container 100 including the resin container main body 10 in which the average thickness T2 in such a region is in the above-described range, it is sufficiently recognized that the amount of resin to be used is very reduced although the liquid retention is good and the liquid is less likely to leak out even when receiving the impact such as dropping.

A volume of the resin container main body 10 can be appropriately determined according to the use of the liquid filling container 100 and the like. A maximum volume of the liquid filling container 100 is preferably 300 ml or more and 2000 ml or less from the viewpoint of being adaptable to any demand from a compact shape to a large capacity. In particular, from the viewpoint of being able to reduce the amount of resin used in the resin container main body 10 and to be well adapted to increasing the capacity, the maximum volume of the liquid filling container 100 is preferably 800 ml or more and 2000 ml or less, and a weight of the resin container main body 10 is more preferably 2 g or more and 22 g or less in the liquid filling container 100 having a large volume in such a range. In the present invention, although the maximum volume of the resin container main body 10 is large as described above, the amount of resin used to form the resin container main body 10 can be suppressed to be sufficiently small, and the moisture-permeable waterproof sheet 30 is less likely to be broken even when dropping in a state of being filled with the liquid.

Note that a filling rate or a scheduled filling rate of the liquid in the liquid filling container 100 is not particularly limited, but can be, for example, about 50% or more and 90% or less with respect to a maximum capacity. Note that the scheduled filling rate is calculated from an assumed amount of liquid to be stored in a type of the liquid filling container 100 in which the resin container main body 10 is filled with the liquefying agent at the start of use and the liquid is stored in the resin container main body 10 by moisture absorption or the like. The scheduled filling rate can be adjusted by an amount of the liquefying agent filled in the resin container main body 10.

In the present invention, the resin container main body 10 is made of a thermoplastic resin. The thermoplastic resin is one resin or a mixture of two or more resins that can be used for general thermoforming, such as a polyethylene-based resin, a nylon-based resin, a polypropylene-based resin, and a polystyrene-based resin.

A form of a resin material forming the resin container main body 10 is not particularly limited, but the resin container main body 10 is preferably formed of a resin sheet. By using the resin sheet, the thickness of the resin container main body 10 can be easily reduced, and by using the resin sheet having an average thickness of 400 μm, the maximum thickness of the formed resin container main body 10 can be reliably adjusted to 400 μm or less.

From the viewpoint of thickness reduction, the resin sheet forming the resin container main body 10 has an average thickness of preferably 400 μm or less, more preferably 360 μm or less, and still more preferably 320 μm or less. Further, from the viewpoint of the shape retainability of the resin container main body 10 and the strength of the container, the average thickness of the resin sheet is preferably 200 μm or more, more preferably 230 μm or more, and still more preferably 260 μm or more.

In the present invention, the average thickness of the resin sheet is obtained by measuring thicknesses in a normal direction of a sheet surface at four points randomly selected in the sheet and arithmetically averaging the measured values.

The resin sheet described above is any sheet that can be used for sheet forming by thermal processing, and examples thereof include a nylon-based resin sheet, a polyethylene-based resin sheet, a polypropylene-based resin sheet, and a polystyrene-based resin sheet. The resin sheet may be a single-layer resin sheet or a laminated resin sheet formed by laminating arbitrary resins. Here, the nylon-based resin sheet includes both a sheet containing only a nylon resin as a resin material and a sheet containing mixed materials of the nylon resin and another resin. The same applies to other resin sheets described above such as the polyethylene-based resin sheet.

Among them, a single-layer nylon-based resin sheet, or a laminated resin sheet having a nylon-based resin layer is preferable as the resin sheet from the viewpoint of excellent pinhole resistance.

From the viewpoint of imparting appropriate flexibility to the resin container main body 10 and enhancing impact absorbability, a single-layer polyethylene-based resin sheet or a laminated resin sheet having a polyethylene-based resin layer is preferable as the resin sheet.

As a specific example more suitable as the resin sheet, for example, a laminated resin sheet having polyethylene-based resin layers on both outermost surfaces and another resin layer between them is preferable from the viewpoint of flexibility. Among them, a laminated sheet formed by laminating the polyethylene-based resin layer, the nylon-based resin layer, and the polyethylene-based resin layer in this order is more preferable from the viewpoint of having both flexibility and pinhole resistance.

In the resin container main body 10, the bottom surface portion 14 may be made of the same resin material as that of the side surface portion 16, or may be made of a different resin material. In consideration of ease of production, disposal, and the like, the bottom surface portion 14 and the side surface portion 16 are preferably made of the same resin material.

A method for producing the resin container main body 10 using the resin sheet is not particularly limited, but a preferable example of producing the resin container main body 10 using one resin sheet 50 will be described below with reference to FIGS. 5A to 5C. FIGS. 5A to 5C are explanatory views for explaining an example of a production process of the resin container main body 10, and illustrate a process of deep-drawing the resin container main body 10 into a predetermined shape by molding (hereinafter, also referred to as plug assist molding) using a plug for molding assistance in deep drawing processing. Drawings illustrated in FIGS. 5A to 5C are longitudinal cross-sectional views.

First, as illustrated in FIG. 5A, the resin sheet 50 which is one resin sheet forming the resin container main body 10 is placed in a desired molding mold 201. The resin sheet 50 is, for example, a sheet-like resin molded product having an average thickness of 400 μm or less. An outer edge portion of the resin sheet 50 is sandwiched by a holding body 204, and a state of being stretched in a horizontal direction is maintained. Note that when the resin container main body 10 is deep-drawn, the resin sheet 50 can also be sucked (vacuum-sucked) from a suction hole 203 provided in the molding mold 201 and processed into a desired shape along an inner wall surface of the molding mold 201 without using the plug assist molding. However, by performing the plug assist molding, it is easy to obtain the resin container main body 10 having a more desired shape.

Note that although a heating device is not illustrated in FIGS. 5A to 5C, a desired resin container main body 10 is easily obtained by appropriately heating and softening the resin sheet 50 before the deep drawing processing.

A plug 202 is paired with the molding mold 201 in an uneven shape. As illustrated in FIG. 5A, the molding mold 201 and the plug 202 face each other with the resin sheet 50 interposed therebetween, and then, as illustrated in FIG. 5B, the resin sheet 50 can be formed into the resin container main body 10 having a desired shape by uneven fitting. By not only vacuum suction but also plug assist molding, it is possible to prevent a thickness of a portion corresponding to the bottom surface portion 14 from becoming too thin at the time of deep drawing processing.

Thereafter, as illustrated in FIG. 5C, the plug 202 is removed from the molding mold 201. Thereafter, by cutting an outer edge region of the resin sheet 50 while leaving a portion to be the flange portion 20, the resin container main body 10 including the flange portion 20 continuous from the upper end of the side surface portion 16 can be formed.

Incidentally, FIG. 1 illustrates the liquid filling container 100 in which the inside of the resin container main body 10 is filled with the liquid 42, but the liquid filling container may be filled with a liquefying agent instead of the liquid 42.

Further, as illustrated in FIGS. 1 and 2, the resin container main body 10 may be in an extended state without the side surface portion 16 being folded, or as illustrated in FIG. 3, the side surface portion 16 may be contracted in the vertical direction. In particular, when the resin container main body 10 is filled with the liquefying agent 44, an apparent volume may be reduced by, for example, degassing the resin container main body 10 with the liquefiable agent 44 filled. In this case, in order to maintain a degassed state until immediately before the start of use, an air-impermeable lid sheet (not illustrated) may be provided on an upper surface side of the moisture-permeable waterproof sheet 30 to maintain a sealed state. Thus, a volume of the liquid filling container 100 before use can be reduced, and transportability and storability can be improved. Since the resin container main body 10 of the present invention is very thin with a maximum thickness of 400 μm or less, the side surface portion 16 is easily contracted by degassing. In addition, after the lid sheet is removed and the sealed state is released, as the liquid is stored inside the resin container main body 10, the side surface portion 16 is gradually extended by weight of the liquid, and the moisture-permeable waterproof sheet is pushed upward, finally resulting in a state illustrated in FIG. 2. That is, as the liquid is stored inside the resin container main body 10, the resin container main body 10 contracted by degassing is restored to a shape close to a shape before degassing.

Note that regarding the resin container main body 10 with the side surface portion 16 being contracted, in the case of measuring the above-described average thickness T3 of the bottom surface portion 14, the average thickness T1 at the predetermined height of the side surface portion 16, the average thickness T2 at the position near the corner R of the quadrilateral bottom surface portion 14, and the volume of the resin container main body 10, measurement is performed in a state where a contracted portion of the side surface portion 16 is extended.

(Moisture-Permeable Waterproof Sheet)

The moisture-permeable waterproof sheet 30 is a sheet that covers the opening 12 of the resin container main body 10, and is a sheet having air permeability and moisture permeability and capable of suppressing permeation of the liquid.

In the present invention, when the direction along the longitudinal direction of the opening 12 of the moisture-permeable waterproof sheet 30 is defined as the sheet longitudinal direction LD, and the direction along the lateral direction of the opening 12 of the moisture-permeable waterproof sheet 30 is defined as a sheet lateral direction SD, the moisture-permeable waterproof sheet 30 is configured such that the tensile breaking strength (N/25 mm) in the sheet longitudinal direction LD and the sheet lateral direction SD is 40 (N/25 mm) or more, and the tensile elongation at break (%) in the sheet lateral direction SD is 60% or more. From the viewpoint of being able to withstand larger impacts, the tensile breaking strength in the sheet longitudinal direction LD and the sheet lateral direction SD is preferably 50 (N/25 mm) or more, more preferably 80 (N/25 mm) or more, and still more preferably 100 (N/25 mm) or more.

As described above, the tensile breaking strength in the sheet longitudinal direction LD and the sheet lateral direction SD is specified to be at least a certain level, and at least the tensile elongation at break in the sheet lateral direction SD is sufficiently ensured, so that an intended problem of the present invention can be satisfactorily solved.

From the viewpoint of better absorbing the impact when dropped and better preventing damage of the moisture-permeable waterproof sheet 30, the tensile elongation at break (%) in the sheet longitudinal direction LD is also preferably 60% or more, and more preferably 80% or more.

Note that as a method for measuring the tensile breaking strength and the tensile elongation at break of the moisture-permeable waterproof sheet 30, the method for measuring these in Examples described later is referred to.

The inventors of the present invention further studied a posture in which the liquid filling container 100 including the thin resin container main body 10 is dropped, and found that among when the liquid filling container 100 is dropped with the bottom surface portion 14 facing downward (hereinafter referred to as drop mode 1), when the liquid filling container 100 is dropped with a longitudinal side surface portion 16*a* (see FIG. 1) facing downward (hereinafter referred to as drop mode 2), and when the liquid filling container 100 is dropped with a lateral side surface portion 16*b* (see FIG. 1) facing downward (hereinafter referred to as drop mode 3), the damage of the moisture-permeable waterproof sheet 30 was most remarkable in the drop mode 3. This is considered to be because when the liquid filling container 100 is dropped onto a floor surface, the drop mode 3 has the smallest contact area between the resin container main body 10 and the floor surface and poor impact dispersibility, resulting in a reduction in impact absorbability.

Therefore, from the viewpoint of sufficiently preventing the damage of the moisture-permeable waterproof sheet 30 even in the drop mode 3, it is preferred that the tensile elongation at break in the sheet lateral direction SD is larger than the tensile elongation at break in the sheet longitudinal direction LD.

The moisture-permeable waterproof sheet 30 only needs to be moisture-permeable and waterproof, and is preferably a microporous film resin sheet. A method for producing the microporous film resin sheet is not particularly limited, but the microporous film resin sheet can be produced by, for example, forming a thermoplastic resin sheet containing an inorganic filler, thereafter, stretching. Examples of the thermoplastic resin used for forming the microporous film resin sheet include polyolefins such as polyethylene and polypropylene, polyvinyl chloride, polyester, and polyamide etc. Examples of a moisture-permeable waterproof film, which is a commercially available product including the microporous film resin sheet, include product name "Cellpore" manufactured by Sumikasekisui film Co., Ltd., product name "NF Sheet" manufactured by Tokuyama Corporation, product name "Breathlon" manufactured by Nitoms, Inc., and product name "Exepol" manufactured by Mitsubishi Chemical Corporation.

A nonwoven fabric or another porous film may be laminated on the microporous film resin sheet to form a multilayer sheet as long as the moisture permeability of the microporous film resin sheet is not impaired.

In the present embodiment, an outer edge region of the moisture-permeable waterproof sheet 30 is adhered, attached and fixed to the flange portion 20 described above.

Examples of an adhesion method to the flange portion 20 include an ultrasonic welding method, a hot plate welding method, and a high frequency welding method, but are not limited thereto. However, the method for attaching the moisture-permeable waterproof sheet 30 to the resin container main body 10 is not particularly limited as long as adhesiveness is maintained to the extent that the liquid does not leak.

(Liquid, Liquefying Agent)

The resin container main body 10 is filled with the liquid 42, the liquefying agent 44, or the liquid 42 stored due to the liquefying agent 44.

The liquid 42 is not particularly limited as long as it is a liquid or a semi-liquid (gel, sol), and can be appropriately selected according to a purpose of use of the liquid filling container 100. Examples of the liquid include but are not limited to liquid or semi-liquid aromatic agents, deodorants, and antifungal agents. These liquids 42 are, for example, vaporized to pass through the moisture-permeable waterproof sheet 30 and be discharged out of the resin container main body 10.

In addition, the liquefying agent 44 only needs to be a solid having an arbitrary shape such as a granular shape, and be any liquefiable agent, and can be appropriately selected according to the purpose of use of the liquid filling container 100. Examples of the liquefying agent include a deliquescent agent that can be used as a moisture absorbent.

The deliquescent agent broadly includes an agent that liquefies by absorbing moisture, and specific examples thereof include deliquescent substances such as calcium chloride, magnesium chloride, lithium chloride, lithium bromide, and potassium acetate. As the deliquescent substance, calcium chloride and magnesium chloride are particularly preferred from the viewpoint of moisture absorption capacity, price, and the like. The deliquescent agent is configured to contain one kind or two or more kinds of known deliquescent substances. For example, the deliquescent agent is formulated in a granular form by a drop granulation method, an air-cooled granulation method, or the like using one or more of the above-described deliquescent substances.

For example, in a case of using the deliquescent agent as the liquefying agent 44, a state in which a part of the deliquescent agent is liquefied after the start of use of the liquid filling container and a remaining portion of the deliquescent agent is present in the liquid, or a state in which it is visually recognized that all the deliquescent agent is liquefied is assumed, but even in these states, the deliquescent agent can exhibit a moisture absorption function. Therefore, in the present invention, there may be no inner tray that partitions the deliquescent agent and the liquid as in the dehumidifying agent container disclosed in Patent Literature 1.

The liquid filling container 100 in which the dehumidifying agent containing the deliquescent agent that liquefies by absorbing moisture is used as the liquefying agent 44 is one of preferred aspects of the present invention. In such an aspect, the resin container main body 10 is filled with the liquefying agent 44 which is solid with the liquid 42 being substantially zero at the start of use, and after the start of use, the deliquescent agent is gradually liquefied due to moisture absorption, the amount of the liquid 42 stored in the resin container main body 10 increases, and the amount of the liquid 42 stored in the resin container main body 10 is maximized at the end of use. In such an aspect, even when a user, for example, lifts or carries the liquid filling container 100 from an installation place to dispose of the used liquid filling container and accidentally drops the liquid filling container 100, it is preferred that the damage of the moisture-permeable waterproof sheet 30 is suppressed and the liquid 42 therein is prevented from leaking.

Hereinabove, although the present invention has been described using the liquid filling container 100, a part of the liquid filling container 100 can be changed or an arbitrary configuration can be added without departing from the scope of the present invention. For example, the liquid filling container 100 may be provided with a lid sheet (not illustrated) that covers the moisture-permeable waterproof sheet 30. The lid sheet only needs to be an air-impermeable sheet that covers the opening 12 with the moisture-permeable waterproof sheet 30 interposed therebetween before use of the liquid filling container 100 and is removed at the time of use. In particular, the liquid filling container 100 in which the resin container main body 10 is filled with the liquefying agent 44 is desirably provided with the lid sheet so that a moisture absorption reaction does not occur until the start of use.

The lid sheet only needs to be impermeable (gas barrier) and may be transparent or opaque. Examples of moisture-impermeable sheets include resin-based sheets such as oriented polypropylene (OPP), polyethylene terephthalate (PET), polyvinylidene chloride-coated PET (K-PET), polyvinylidene chloride-coated OPP (K-OPP), silica-deposited PET, and alumina-deposited PET, as well as aluminum sheets, and these moisture-impermeable sheets may be used as a single layer or as a composite (laminate) of a plurality of layers.

EXAMPLES

Hereinafter, the present invention will be specifically described with reference to Examples and Comparative Example, but the present invention is not limited to the following Examples at all. The tensile breaking strength (N/25 mm) and the tensile elongation at break (%) of the moisture-permeable waterproof sheets used in the Examples and Comparative Example in the sheet lateral direction and the sheet longitudinal direction, and evaluation results of Examples described later are shown in Table 1.

Example 1

A moisture-impermeable multilayer film (thickness: 300 μm) composed of three layers of a polyethylene-based resin, a nylon-based resin, and a polyethylene-based resin laminated in this order was set in a molding mold of a vacuum pressure molding machine capable of performing the deep drawing processing. Then, the multilayer film was subjected to plug assist molding while being evacuated to form a resin container main body with a short side of 125 mm, a long side of 190 mm, and a depth of 80 mm, and having a rectangular opening in which the entire upper surface was opened. At this time, in addition, the flange portion extending outwardly from the opening portion was simultaneously formed. A width dimension of the flange portion was 15 mm on the short side of the opening and 18 mm on the long side of the opening. In the resin container main body thus obtained, the average thickness T3 of the bottom surface portion referred to in FIG. 4 was 250 μm, the average thickness T1 at the predetermined height of the side surface portion was 60 μm, and the average thickness T2 at the position near the corner R of the bottom surface portion was 110 μm. Further, the maximum volume of the resin container main body formed as described above was 1300 ml, and the weight was 7 g.

The resin container main body formed as described above was filled with the deliquescent agent (calcium chloride dihydrate: 355 g). Note that 355 g of calcium chloride dihydrate is an amount of the deliquescent agent capable of absorbing about 850 g of moisture.

Subsequently, the moisture-permeable waterproof sheet was thermally welded to an upper surface of the flange portion to obtain a liquid filling container of Example 1. Note that as the moisture-permeable waterproof sheet, a sheet was used which was obtained by bonding a nonwoven fabric having a sheath core structure in which a core layer was made of polyethylene terephthalate and a sheath layer was made of polyethylene to both surfaces of a polyolefin-based microporous film and which exhibited the tensile breaking strength (N/25 mm) and the tensile elongation at break (%) shown in Table 1.

Examples 2 and 3 and Comparative Example 1

Liquid filling containers were prepared as Examples 2 and 3 and Comparative Example 1 in the same manner as in Example 1 except that the moisture-permeable waterproof sheet in which the tensile breaking strength and the tensile elongation at break in the sheet lateral direction and the tensile breaking strength and the tensile elongation at break in the sheet longitudinal direction were changed to values shown in Table 1 was used.

<Method for Measuring Tensile Breaking Strength (N/25 mm) and Tensile Elongation at Break (%)>

The tensile breaking strength of the moisture-permeable waterproof sheet used in Examples and Comparative Example was measured as follows.

A test piece having a width of 25 mm and a length of 80 mm was cut out from a sheet exhibiting moisture-permeable waterproofness. Here, a width direction of the test piece was aligned with a direction to be the sheet lateral direction when the test piece was used in the liquid filling container, and a length direction of the test piece was aligned with a direction to be the sheet longitudinal direction when the test piece was used in the liquid filling container. Both ends of the test piece in the length direction were held by a holder of a tensile tester, the test piece was pulled under conditions of a tensile speed of 200 mm/min and a distance between chucks of 50 mm under an environment of 25° C. and 60% RH in accordance with JIS K 7127:1999, and the tensile breaking strength and the tensile elongation at break when the test piece was broken were measured. This measurement was performed five times. From the obtained measured values, an arithmetic average value was determined for each of the tensile breaking strength and the tensile elongation at break, and this was defined as the tensile breaking strength (N/25 mm) and the tensile elongation at break (%) in the sheet longitudinal direction.

In addition, the test was performed five times in the same manner as described above except that the width direction of the test piece was aligned with the direction to be the sheet longitudinal direction when the test piece was used in the liquid filling container, and the length direction of the test piece was aligned with the direction to be the sheet lateral direction when the test piece was used in the liquid filling container, and the arithmetic average value was defined as the tensile breaking strength (N/25 mm) and the tensile elongation at break (%) in the sheet lateral direction.

Note that as the tensile tester, Forcetester MCT2105 SPEEDCONTROL manufactured by A&D Company, Limited was used.

<Impact Resistance Test (1)>

The liquid filling container of Examples and Comparative Example prepared as described above was placed in a room, and the deliquescent agent filled in the resin container main body was moistened and liquefied. A sample obtained by storing 800 ml of liquid in the resin container main body was used as a sample after moisture absorption.

The sample after moisture absorption was allowed to stand in an environment at 25° C. for 24 hours or more, and subjected to an impact resistance test (1) in accordance with a drop impact test of JIS S 3106:1994. Specifically, the sample after moisture absorption was dropped from a height of 1 m with the bottom surface facing downward onto a surface of a smooth oak plate having a thickness of 30 mm, and then a damage state of the sample after moisture absorption was visually observed and evaluated as follows.

○—No damage was observed, and no liquid leakage occurred.

x—Damage of the moisture-permeable waterproof sheet was observed.

As shown in Table 1, in Comparative Example 1, although the tensile breaking strength in the sheet lateral direction was sufficiently large, the tensile elongation at break was small, and thus evaluation in the impact resistance test (1) was poor.

On the other hand, it has been recognized that Examples in which the tensile breaking strength (N/25 mm) in both the sheet longitudinal direction and the sheet lateral direction is 40 (N/25 mm) or more, and the tensile elongation at break (%) in the sheet lateral direction is 60% or more are all evaluated well in the impact resistance test (1), and solve the intended problem of the present invention.

<Impact Resistance Test (2) (Severe Test)>

A sample after moisture absorption was prepared in the same manner as in the impact resistance test (1), and an impact resistance test (2) was performed under more severe conditions as follows.

Specifically, the sample after moisture absorption was allowed to stand in an environment of 25° C. for 24 hours or more, and dropped from a height of 50 cm with the short side surface facing downward onto a surface of a smooth oak plate having a thickness of 30 mm, and then a damage state of the sample after moisture absorption was visually observed.

When no damage was observed by visual observation after the drop test of 50 cm described above, a height of drop start was increased by 10 cm, and the same drop test was performed. A drop height when the damage occurred and liquid leakage occurred was defined as the damage height, and was shown in Table 1.

As shown in Table 1, in Examples 1 and 2 in which the tensile elongation at break (%) in the sheet longitudinal direction was 60% or more, no damage was observed when the sample was dropped from the height of 50 cm in the impact resistance test (2), and more excellent impact resistance was observed.

Further, in Example 1 in which the tensile elongation at break (%) in the sheet lateral direction was larger than the tensile elongation at break (%) in the sheet longitudinal direction, the damage height was the highest in the impact resistance test (2), and very excellent impact resistance was observed.

TABLE 1

| | Sheet lateral direction | | Sheet longitudinal direction | | | |
|---|---|---|---|---|---|---|
| | Tensile breaking strength (N/25 mm) | Tensile elongation at break (%) | Tensile breaking strength (N/25 mm) | Tensile elongation at break (%) | Impact resistance test (1) | Impact resistance test (2) |
| Example 1 | 50 | 94 | 122 | 82 | ○ | 90 cm |
| Example 2 | 122 | 82 | 50 | 94 | ○ | 80 cm |
| Example 3 | 50 | 76 | 118 | 48 | ○ | ≤50 cm |
| Comparative Example 1 | 118 | 48 | 50 | 76 | x | ≤50 cm |

The present invention described above includes the following technical ideas.

(1) A liquid filling container including:
- a resin container main body having an opening in an upper portion;
- a moisture-permeable waterproof sheet covering the opening; and
- a liquefying agent or a liquid filled in the resin container main body, wherein
- a maximum thickness of the resin container main body is 400 μm or less, and
- when a direction along a longitudinal direction of the opening of the moisture-permeable waterproof sheet is defined as a sheet longitudinal direction, and a direction along a lateral direction of the opening of the moisture-permeable waterproof sheet is defined as a sheet lateral direction,
- a tensile breaking strength in the sheet longitudinal direction and the sheet lateral direction is 40 (N/25 mm) or more, and
- a tensile elongation at break in the sheet lateral direction is 60% or more.

(2) The liquid filling container according to the above (1), in which the resin container main body is formed of a resin sheet.

(3) The liquid filling container according to the above (1) or (2), in which the tensile elongation at break in the sheet longitudinal direction is 60% or more.

(4) The liquid filling container according to any one of the above (1) to (3), in which the tensile elongation at break in the sheet lateral direction is greater than the tensile elongation at break in the sheet longitudinal direction.

(5) The liquid filling container according to any one of the above (1) to (4), in which
- a maximum volume of the resin container main body is 800 ml or more and 2000 ml or less, and
- a weight of the resin container main body is 2 g or more and 22 g or less.

(6) The liquid filling container according to any one of the above (1) to (5), in which the liquefying agent is a dehumidifying agent containing a deliquescent agent that liquefies by absorbing moisture.

REFERENCE SIGNS LIST

10 Resin container main body
12 Opening
14 Bottom surface portion
16 Side surface portion
16*a* Longitudinal side surface portion
16*b* Lateral side surface portion 20 Flange portion
30 Moisture-permeable waterproof sheet
42 Liquid
44 Liquefying agent
50 Resin sheet
100 Liquid filling container
201 Molding mold
202 Plug
203 Suction hole
204 Holding body
LD Sheet longitudinal direction
SD Sheet lateral direction
H1, H2 Height
T1, T2, T3 Average thickness
R Corner

The invention claimed is:

1. A liquid filling container comprising:
- a resin container main body having an opening in an upper portion;
- a moisture-permeable waterproof sheet covering the opening; and
- a liquefying agent or a liquid filled in the resin container main body, wherein
- a maximum thickness of the resin container main body is 400 μm or less, and
- when a direction along a longitudinal direction of the opening of the moisture-permeable waterproof sheet is defined as a sheet longitudinal direction, and a direction along a lateral direction of the opening of the moisture-permeable waterproof sheet is defined as a sheet lateral direction,
- a tensile breaking strength in the sheet longitudinal direction and the sheet lateral direction is 40 (N/25 mm) or more, and
- a tensile elongation at break in the sheet lateral direction is 60% or more.

2. The liquid filling container according to claim 1, wherein the resin container main body is formed of a resin sheet.

3. The liquid filling container according to claim 1, wherein the tensile elongation at break in the sheet longitudinal direction is 60% or more.

4. The liquid filling container according to claim 1, wherein the tensile elongation at break in the sheet lateral direction is greater than the tensile elongation at break in the sheet longitudinal direction.

5. The liquid filling container according to claim 1, wherein
- a maximum volume of the resin container main body is 800 ml or more and 2000 ml or less, and
- a weight of the resin container main body is 2 g or more and 22 g or less.

6. The liquid filling container according to claim 1, wherein the liquefying agent is a dehumidifying agent containing a deliquescent agent that liquefies by absorbing moisture.

7. The liquid filling container according to claim 1, wherein the tensile elongation at break in the sheet longitudinal direction is 60% or more, and the tensile elongation at break in the sheet lateral direction is greater than the tensile elongation at break in the sheet longitudinal direction.

* * * * *